US008042805B2

(12) United States Patent
Angst et al.

(10) Patent No.: US 8,042,805 B2
(45) Date of Patent: Oct. 25, 2011

(54) MACHINE FOR PROCESSING PRINTED SHEETS

(75) Inventors: Uwe Angst, Jockgrim (DE); Andreas Fricke, Eberbach (DE); Marco Krämer, Dossenheim (DE); Joachim Zarges, Mannheim/Friedrichsfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 798 days.

(21) Appl. No.: 11/940,343

(22) Filed: Nov. 15, 2007

(65) Prior Publication Data

US 2008/0293532 A1 Nov. 27, 2008

(30) Foreign Application Priority Data

Nov. 15, 2006 (DE) ..... 10 2006 053 795

(51) Int. Cl.
*B65H 43/04* (2006.01)

(52) U.S. Cl. ..... 271/199; 271/204

(58) Field of Classification Search ..... 271/277, 271/205, 176, 199, 82, 85, 204
See application file for complete search history.

(56) References Cited

U.S. PATENT DOCUMENTS

| | | | | |
|---|---|---|---|---|
| 3,861,672 | A * | 1/1975 | Norton | 271/203 |
| 4,201,286 | A * | 5/1980 | Meier | 198/461.3 |
| 5,431,386 | A * | 7/1995 | Blaser | 271/204 |
| 2004/0113350 | A1 * | 6/2004 | Forch et al. | 271/69 |
| 2005/0067774 | A1 | 3/2005 | Forch et al. | |

FOREIGN PATENT DOCUMENTS

DE 102004018415 A1 4/2005

* cited by examiner

*Primary Examiner* — Stefanos Karmis
*Assistant Examiner* — Thomas Morrison
(74) *Attorney, Agent, or Firm* — Laurence A. Greenberg; Werner H. Stemer; Ralph E. Locher

(57) ABSTRACT

A machine for processing printed sheets includes a sheet delivery having a first conveying device for leading sheet ends, a second conveying device for trailing sheet ends, and a setting device for adjusting one of the two conveying devices relative to the other in a manner dependent on sheet format. The setting device includes a variable ratio gear unit for superimposing two movements.

10 Claims, 3 Drawing Sheets

MACHINE FOR PROCESSING PRINTED SHEETS

CROSS-REFERENCE TO RELATED APPLICATION

This application claims the priority, under 35 U.S.C. §119, of German Patent Application DE 10 2006 053 795.5, filed Nov. 15, 2006; the prior application is herewith incorporated by reference in its entirety.

BACKGROUND OF THE INVENTION

Field of the Invention

The present invention relates to a machine for processing printed sheets, including a sheet delivery having a first conveying device for leading sheet ends, a second conveying device for trailing sheet ends, and a setting device for adjusting one of the two conveying devices relative to the other in a manner dependent on sheet format.

In such a machine, each printing material sheet is held firmly at the leading sheet end during its transport, by the first conveying device and is held firmly at the same time at the trailing sheet end, by the second conveying device. The conveying devices can, for example, be chain conveyors having gripper bars.

German Published, Non-Prosecuted Patent Application DE 10 2004 018 415 A1, corresponding to U.S. Patent Application Publication No. US 2005/0067774 A1, discloses a printing press which is configured in the manner described above. The sheet delivery of that printing press includes a pair of endless chains, to which a gripper bar unit for the rear sheet edges is fastened. A further pair of endless chains, to which a gripper bar unit for front sheet edges is fastened, is disposed between those chains. One chain pair is guided by a chain sprocket pair which is seated fixedly on a hollow shaft. The other chain pair is guided by a further chain sprocket pair which is seated fixedly on an inner shaft that is disposed in the hollow shaft. An electric actuating motor is provided in order for it to be possible for the gripper bars which are provided for holding the rear sheet edges to be adjusted to different spacings from the front edge gripper bars. A pinion which can be pushed into engagement with a gearwheel that is seated fixedly on the inner shaft is seated on the motor shaft of the electric actuating motor. When the pinion is in engagement with the gearwheel, the actuating motor can rotate the inner shaft relative to the hollow shaft, with the result that one chain sprocket pair is rotated relative to the other chain sprocket pair, resulting in one chain pair being adjusted relative to the other chain pair and as a result of which, ultimately, one gripper bar unit is adjusted in accordance with the desired sheet format relative to the other in the chain circulating direction. However, in order to permit the actuating motor to rotate the inner shaft relative to the hollow shaft, a coupling has to be released before the rotation. The coupling is closed in printing operation and connects the inner shaft fixedly in terms of rotation to the hollow shaft, with the result that synchronous running of the chain conveyors is ensured.

Reference is made in the above-mentioned German Published, Non-Prosecuted Patent Application DE 10 2004 018 415 A1, corresponding to U.S. Patent Application Publication No. US 2005/0067774 A1, to the fact that the format is preferably set when the machine is at a standstill, during which time the hollow shaft does not rotate. In that structural system, the machine standstill is actually even a precondition for the format setting, as has been proven subsequently.

However, it is desirable for it to be possible to carry out the format setting while the machine is running, for the reasons which will be explained in the following text. The correct phase position of the rear edge gripper bars relative to those devices of an impression cylinder which hold the rear sheet edges has to be ensured for the adjustment of the spacing of the rear edge gripper bars relative to the front edge gripper bars. The impression cylinder is a constituent part of a printing unit which is disposed immediately in front of the sheet delivery. During the transfer of the printed sheet from the impression cylinder to the chain conveyors, the respective rear edge gripper bar has to be situated in the exact rotary angle position relative to the rotary angle position of the rear edge holding device of the impression cylinder, in order to ensure that the rear sheet edge can be transferred without disruptions from the impression cylinder to the rear edge gripper bar. The control of the transfer without disruptions and precision adjustment, which may be required to eliminate any disruptions, of the chain conveyor which carries the rear edge gripper bars, are at best possible while the machine is running, during test running when setting up the machine.

BRIEF SUMMARY OF THE INVENTION

It is accordingly an object of the invention to provide a machine for processing printed sheets, which overcomes the hereinafore-mentioned disadvantages of the heretofore-known devices of this general type and which permits an adjustment of one of two conveying devices relative to the other, while the machine is running.

With the foregoing and other objects in view there is provided, in accordance with the invention, a machine for processing printed sheets. The machine comprises a sheet delivery having a first conveying device for leading sheet ends and a second conveying device for trailing sheet ends. A setting device is provided for sheet-format-dependent adjustment of one of the first and second conveying devices relative to the other. The setting device includes a gear unit for superimposing two movements.

This gear unit for superimposing two movements makes it possible to superimpose the format setting movement on the circulating drive movement. For example, the second conveying device which holds the rear sheet edges fixedly during sheet transport can be adjusted through the use of the gear unit for superimposing two movements during uninterrupted machine running, into a phase position relative to the first conveying device which holds the front sheet edges. That phase position is correlated with the format of the printed sheets of the imminent print job. During this adjustment of the second conveying device in a manner which is dependent on the sheet format, the phase position of the second conveying device relative to an impression cylinder of a printing unit which is disposed in front of the sheet delivery, can be monitored visually by the operator and can be adjusted if required.

An additional advantage of the machine according to the invention is to be seen in its reduced wear. In the setting device of the above-described prior art (German Published, Non-Prosecuted Patent Application DE 10 2004 018 415 A1, corresponding to U.S. Patent Application Publication No. US 2005/0067774 A1), the coupling halves which can be brought into and out of engagement and likewise the gearwheel and the pinion which can be brought into and out of engagement with the gearwheel, are subjected to considerable abrasion wear. The problem of abrasion wear would also exist in the prior art if, instead of the gearwheel and the pinion, a different coupling were to be used, having one coupling half which, during engagement, would first have to find the position which is required for latching relative to the other coupling half through the use of what is known as a search run. In contrast, in the gear unit for superimposing two movements of the machine according to the invention, elements of this type which can be brought into and out of engagement are not required. The gear unit for superimposing two movements requires neither a coupling nor gearwheels which can be pushed into and out of engagement with one another. A search run for finding the correct coupling or latching position is not required. Instead, the gearwheels of the gear unit for superimposing two movements are in permanent engagement with one another, with the result that latching and release of those gearwheels, which is particularly intensive in terms of wear, is avoided.

A further additional advantage which results from the presence of the gear unit for superimposing two movements in the machine according to the invention relates to the reduced requirements with regard to the synchronous running monitoring by sensors, which can even optionally be dispensed with completely. In the above-described prior art (German Published, Non-Prosecuted Patent Application DE 10 2004 018 415 A1, corresponding to U.S. Patent Application Publication No. US 2005/0067774 A1), there is the risk that the frictional coupling which connects the hollow shaft to the inner shaft might slip during printing operation, as a result of which synchronous running would be at risk. In order to avoid machine malfunctions which result from the synchronous running deviations, to detect the coupling slip at an early stage and to interrupt machine running immediately in the event of an accident, comparatively complicated sensors are required which include various signal transmitters. Since, as has already been said, a frictional coupling of that type is not required in the machine according to the invention, the sensors can be simplified in this case or they can be dispensed with completely.

In accordance with another feature of the invention, one of the two conveying devices has a hollow shaft and the other of the two conveying devices has an inner shaft which is disposed in the hollow shaft. In this case, the hollow shaft and the inner shaft are coupled to one another by the gear unit for superimposing two movements. The first conveying device which holds the printed sheets firmly at their leading sheet ends preferably has the hollow shaft, and the second conveying device which holds the printed sheets firmly at their trailing sheet ends has the inner shaft.

In accordance with a further feature of the invention, a drive motor for driving the two conveying devices and an actuating motor for adjusting one of the two conveying devices relative to the other in a manner which is dependent on the sheet format, are connected to the gear unit for superimposing two movements. While the machine is running, the drive motor drives the circulating movement of the two conveying devices. The drive motor and the actuating motor are preferably electric motors.

In accordance with an added feature of the invention, there is provided an overall gear mechanism which includes a first partial gear mechanism and a second partial gear mechanism. The gear unit for superimposing two movements forms the first partial gear mechanism. When the actuating motor is at a standstill, the overall gear mechanism has a transmission ratio which is 1:1.

In accordance with an additional feature of the invention, the gear unit for superimposing two movements and the second partial gear mechanism are planetary gear mechanisms having sun gears which form a double gear that is coaxial with respect to the two shafts. Accordingly, the gear unit for superimposing two movements includes a first sun gear and the second partial gear mechanism includes a second sun gear, and the two sun gears are either connected fixedly to one another or are manufactured together from one piece. In both cases, the two sun gears form what is known as a double gear that is disposed coaxially with respect to the hollow shaft and the inner shaft.

In accordance with yet another feature of the invention, the overall gear mechanism includes a housing and a double gear which is mounted eccentrically with respect to the two shafts and in a stationary manner in the housing. Accordingly, the geometric rotational axis of the double gear extends parallel to the geometric rotational axis of the inner shaft and the hollow shaft.

In accordance with yet a further feature of the invention, the two shafts are coupled to one another by the overall gear mechanism in such a way that, when the actuating motor is at a standstill, the two shafts can be rotated synchronously with one another by the drive motor. The inner shaft and the hollow shaft therefore rotate at the same rotational speed when the actuating motor is not rotating. In this operating situation, the gear unit for superimposing two movements does not superimpose the drive movements of the two motors and the two shafts are driven exclusively by the drive motor.

In accordance with yet an added feature of the invention, the two shafts are coupled to one another by the overall gear mechanism in such a way that, when the drive motor is running, one of the two shafts can be rotated by the actuating motor relative to the other. Accordingly, the adjustment, which is dependent on the sheet format, of one of the two conveying devices relative to the other, takes place while the machine is running. This adjustment is brought about by the rotation, driven by the actuating motor, of one of the two shafts relative to the other.

In accordance with yet an additional feature of the invention, one of the two conveying devices has a first pair of chain sprockets and the other of the two conveying devices has a second pair of chain sprockets. The two chain sprockets of the first chain sprocket pair are seated fixedly in terms of rotation on the hollow shaft and are wrapped around by a first pair of chains. Moreover, in this embodiment, the other of the two conveying devices has a second pair of chain sprockets which are seated fixedly in terms of rotation on the inner shaft and are wrapped around by a second pair of chains. Accordingly, the first conveying device is a first chain conveyor and the second conveying device is a second chain conveyor, and the chain conveyors each include at least two chain sprockets and two endless chains which are guided by the chain sprockets.

In accordance with again another feature of the invention, holding crossmembers are attached to one pair of chains for holding the printed sheets at their leading sheet ends, and holding crossmembers are attached to the other pair of chains for holding the printed sheets at their trailing sheet ends. The holding crossmembers can, for example, be gripper bars having grippers which are disposed in a row and clamp the printed sheet, in order to hold it.

In accordance with a concomitant feature of the invention, the gear unit for superimposing two movements is an epicyclic gear mechanism, preferably a planetary gear mechanism.

Other features which are considered as characteristic for the invention are set forth in the appended claims.

Although the invention is illustrated and described herein as embodied in a machine for processing printed sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
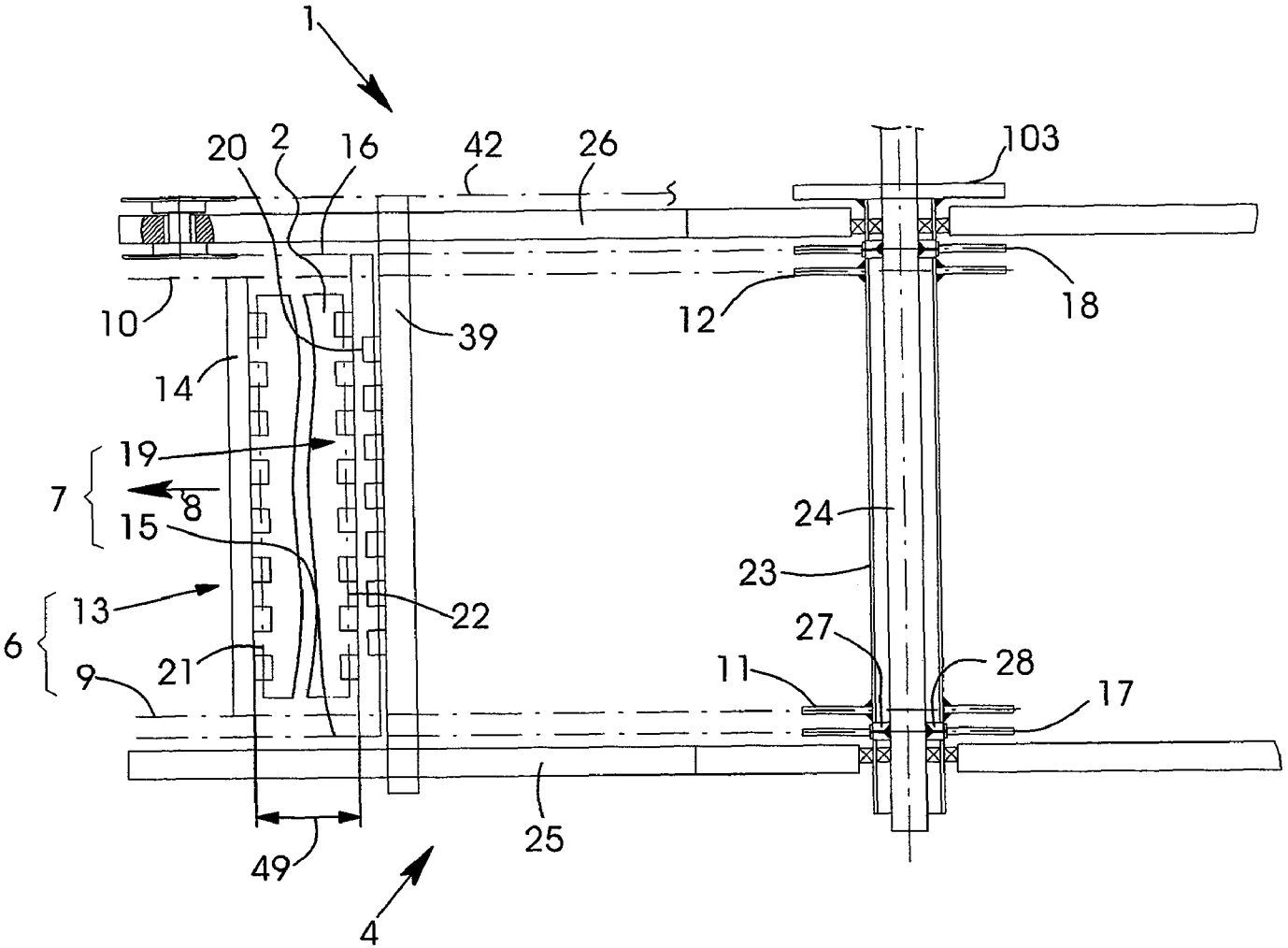
FIG. 1 is a fragmentary, diagrammatic, plan view of a sheet delivery having conveying devices for leading and trailing sheet ends.

Referring now in detail to the figures of the drawings, in which elements and components that correspond to one another are denoted by the same designations, and first, particularly, to FIG. 1 thereof, there is seen a portion of a machine 1 for processing printed sheets 2. The machine 1 is a printing press and includes at least one printing unit 3 having an impression cylinder 5 (see FIGS. 2 and 3) which can be an offset printing unit or a flexographic printing unit that is used, for example, for varnishing. A sheet delivery 4 includes a first conveying device 6 and a second conveying device 7. The conveying devices 6, 7 are chain conveyors and circulate in a circulating direction 8.

The first conveying device 6 includes endless chains 9, 10, chain sprockets 11, 12 for driving and diverting the chains 9, 10 and a holding crossmember unit 13 which is fastened to the chains 9, 10. The holding crossmember unit 13 includes a plurality of holding crossmembers which are disposed in a uniformly distributed manner along the chains 9, 10. However, only a single holding crossmember 14 thereof is shown in the drawing for reasons of clarity. The total assembly of the chains 9, 10 and the holding crossmember unit 13 is also denoted as a front edge gripping system in the following text. The second conveying device 7 includes endless chains 15, 16, chain sprockets 17, 18 for driving and diverting the chains 15, 16 and a holding crossmember unit 19 which is fastened to the chains 15, 16. The holding crossmember unit 19 includes a plurality of holding crossmembers which are disposed in a uniformly distributed manner along the chains 15, 16. However, only a single holding crossmember 20 is shown in the drawing for reasons of clarity. The chains 15, 16 and the holding crossmember unit 19 are also denoted together as a rear edge gripping system in the following text.

The holding crossmembers of the second conveying device 7 together with the holding crossmembers of the first conveying device 6 form holding crossmember pairs, each of which holds one respective printed sheet 2 firmly at its leading sheet end 21 and at the same time at its trailing sheet end 22, as seen in the circulating direction 8. In FIG. 1, the sheet ends 21, 22 which are held firmly are indicated by way of phantom lines using the example of the holding crossmember pair which is formed by the holding crossmembers 14, 20.

The holding crossmembers of the first conveying device 6 are gripper bars and hold the printed sheets 2 firmly by clamping force. The holding crossmembers of the second conveying device 7 are also gripper bars, through the use of which the printed sheets 2 are held in a clamped manner.

A first shaft 23 (known as a front edge shaft 23) carries the chain sprockets 11, 12, which are seated fixedly thereon, of the first conveying device 6 which holds the front sheet edges, and is configured as a hollow shaft. A second shaft 24 (known as a rear edge shaft 24) carries the chain sprockets 17, 18, which are seated fixedly thereon, of the second conveying device 7 which holds the rear sheet edges, and extends through the hollow first shaft 23. The first shaft 23 and its chain sprockets 11, 12 are disposed coaxially with respect to the second shaft 24 and its chain sprockets 17, 18. The shafts 23, 24 are mounted rotatably in side walls 25, 26.

Each of the chain sprockets 17, 18 includes an annular gear which is disposed outside the first shaft 23 and is provided with diametral supporting spokes 27, 28. The supporting spokes 27, 28 protrude into the first shaft 23 through slots which are made in the first shaft 23. The respective annular gear is fastened to the inner, second shaft 24 through the supporting spokes 27, 28. If the second shaft 24 and therefore the chain sprockets 17, 18 are rotated relative to the first shaft 23 and therefore the chain sprockets 11, 12, which rotation takes place for the purpose of a format setting that will be explained in greater detail in the following text, the supporting spokes 27, 28 slide along the slots. The length of the slots, which extends in the circulating direction of the first shaft 23, is dimensioned in correlation with a format difference which exists between a possible minimum and a possible maximum format length of the printed sheets 2.

Figure 2:
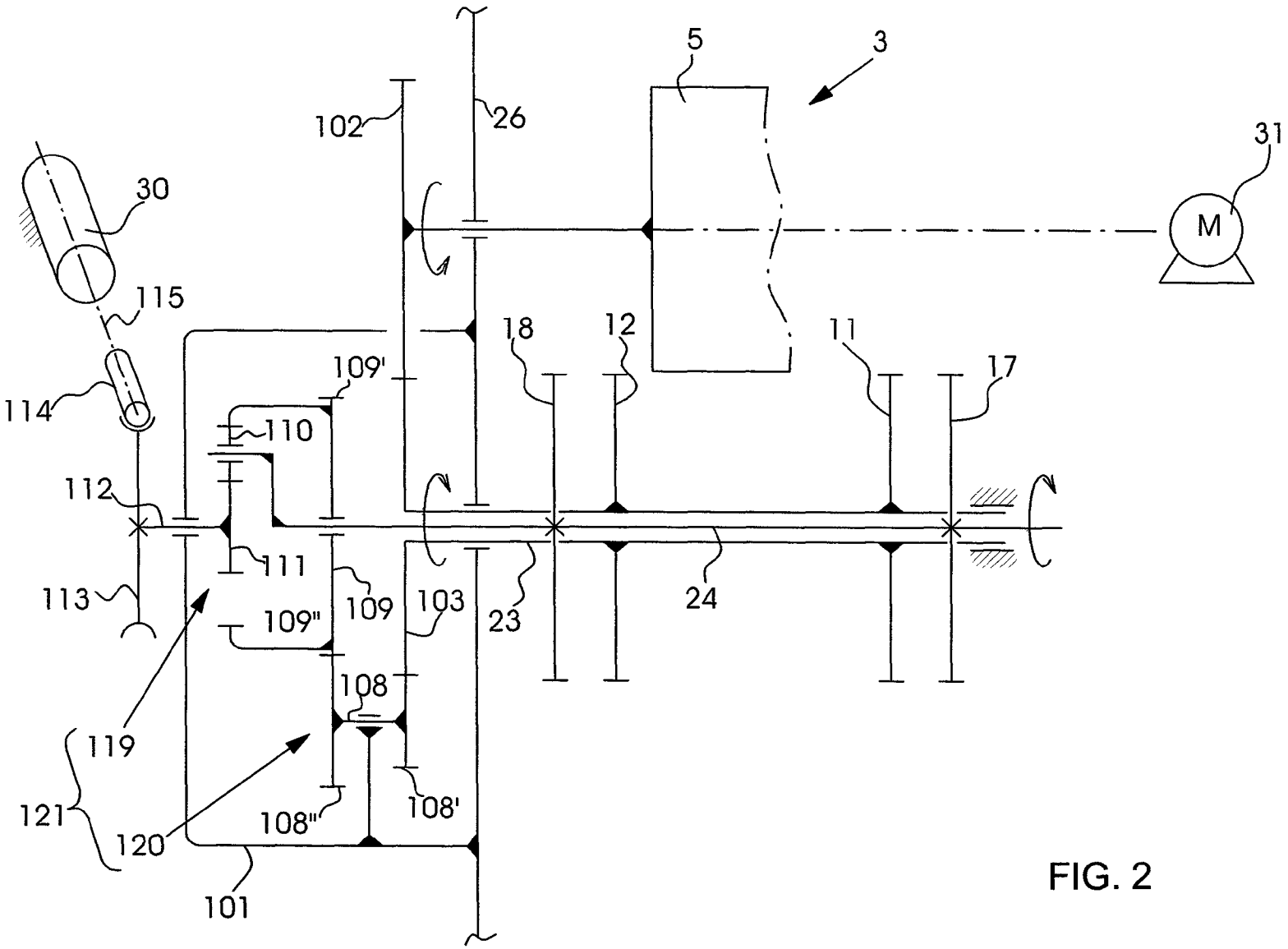
FIG. 2 is a fragmentary, diagrammatic and schematic view of a first exemplary embodiment of a format setting device of the sheet delivery of FIG. 1.
Figure 3:
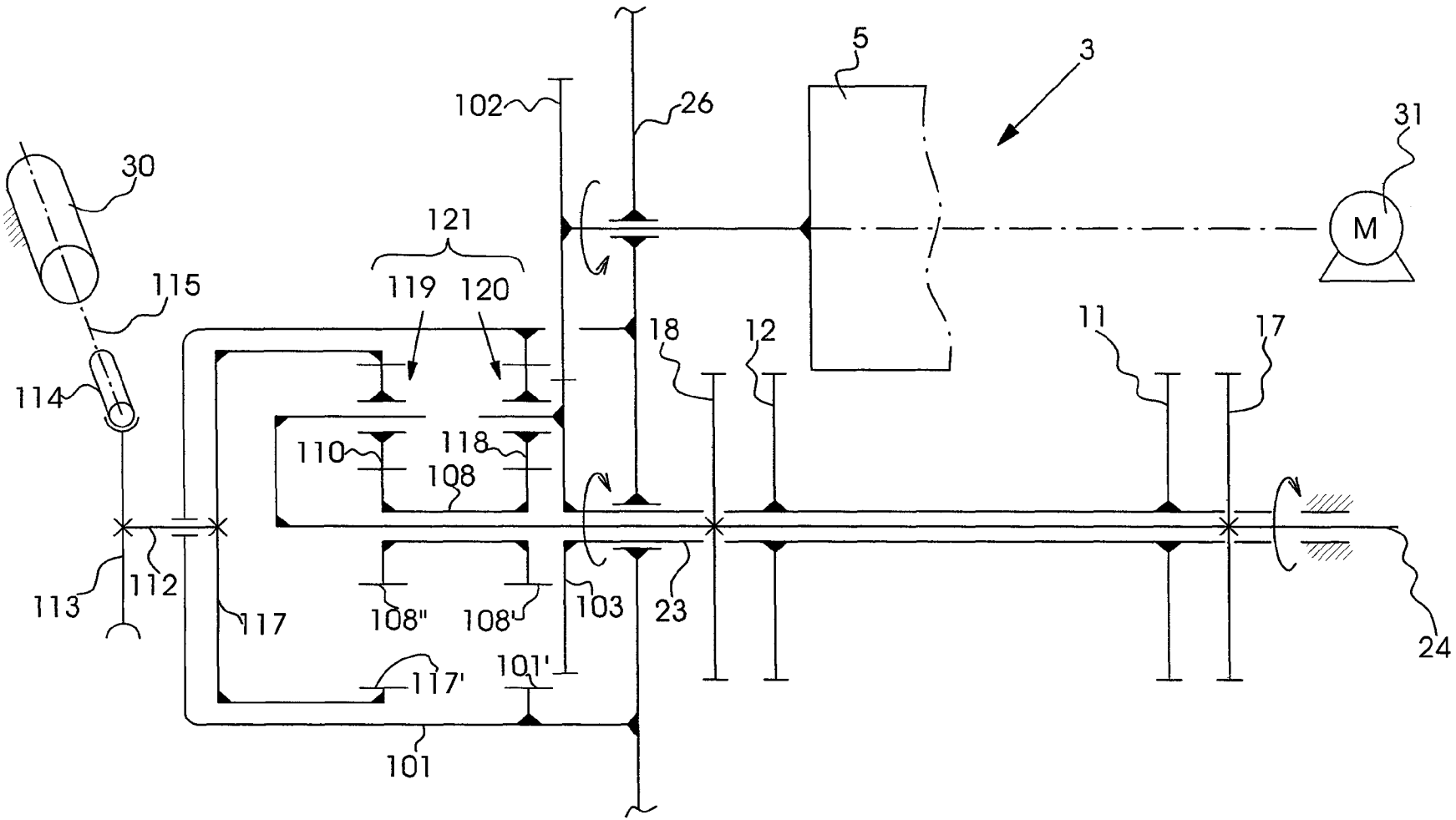
FIG. 3 is a fragmentary, diagrammatic and schematic view of a second exemplary embodiment of the format setting device of the sheet delivery of FIG. 1.

As is seen in FIGS. 2 and 3, during format setting, the second shaft 24 is driven rotationally by a first electric motor 30. The first motor 30 is an actuating drive which is different than a second electric motor 31 that is the main drive of the machine 1 and, in printing operation, drives not only the printing unit 3 including the rotation of the impression cylinder 5, but also the conveying device 6, 7 and its movement which takes place in the circulating direction 8. The circulating phase position of the second conveying device 7 can be changed relative to the first conveying device 6 by rotating the second shaft 24 relative to the first shaft 23 and in the process adjusting the chains 15, 16 relative to the chains 9, 10. As a result of this rotation and chain adjustment, the holding crossmembers of the second conveying device 7 are set to a smaller or greater spacing 49, which is correlated with the sheet format, relative to the holding crossmembers of the first conveying device 6, depending on the rotational direction of the second shaft 24.

FIGS. 2 and 3 each show that the first motor 30 transmits its rotational movement, which is required for the format setting, to a drive shaft 112 through a gear mechanism which has a self-locking configuration. In the illustrated exemplary embodiments, the gear mechanism with the self-locking configuration is a worm gear mechanism which includes a worm 114 that is seated fixedly on a motor shaft 115 of the first motor 30 and a worm gear 113 which is seated fixedly on the drive shaft 112.

The drive shaft 112 is mounted rotatably in a housing 101 of an overall gear mechanism 121. The housing 101 is fastened to the side wall 26 on its side which faces away from the chain sprockets 11, 12, 17, 18. The overall gear mechanism 121 includes a first partial gear mechanism in the form of a gear unit 119 for superimposing two movements and a second partial gear mechanism 120. The drive movement of the second motor 31 is transmitted through a gearwheel 102, which is connected fixedly in terms of rotation to the impression cylinder 5, to a gearwheel 103 of the overall gear mechanism 121 that meshes with the gearwheel 102.

In the first exemplary embodiment which is shown in FIG. 2, the gearwheel 103 is in engagement with a first toothing system 108' of a double gear 108 which has a second toothing system 108" that is in engagement with an external toothing system 109' of an internal gear 109. The double gear 108 is mounted rotatably in a carrying arm which is formed by a rib of the housing 101 in the interior of the latter. The internal gear 109 has an internal toothing system 109", through which it is in engagement with a planetary gear 110. The planetary gear 110 is connected to the rear edge shaft 24 through a web or planetary gear carrier, on which the planetary gear 110 is mounted rotatably. Moreover, the planetary gear 110 is in engagement with a sun gear 111 which is seated fixedly on the drive shaft 112. The gear unit 119 for superimposing two movements includes the internal toothing system 109" of the internal gear 109, the planetary gear 110 and the sun gear 111.

During printing operation, the first motor 30 is at a standstill and only the second motor 31 is operating. The self-locking action of the self-locking gear mechanism, which is formed of the worm gear 113 and the worm 114, prevents transmission of the drive movement of the second motor 31 to the first motor 30 and ensures its standstill, with the result that a motor brake for the first motor 30 is not required. The gear transmission ratio of the second partial gear mechanism 120, which is formed of the gearwheel 103 that is seated on the front edge shaft 23, the double gear 108 and the external toothing system 109' of the internal gear 109, is configured in conjunction with the static transmission ratio of the gear unit 119 for superimposing two movements, in such a way that there is synchronism or synchronous running between the front edge shaft 23 and the rear edge shaft 24 and therefore the constancy of the spacing 49 (see FIG. 1) is ensured.

The static transmission ratio of the gear unit 119 for superimposing two movements is the negative value of the quotient which is formed by the division of the tooth number of the internal toothing system 109" by the tooth number of the sun gear 111. It is advantageous to select the static transmission ratio of the gear unit 119 for superimposing two movements to be smaller than −5, in order to ensure that the torque which reacts on the drive shaft 112 is only a fraction of the torque of the rear edge gripping system which acts on the rear edge shaft 24. The loading of the toothing system in the self-locking gear mechanism (worm 114, worm gear 113) and the motor moment which is to be applied by the first motor 30 during the format adjustment, which takes place while the machine is running, are therefore advantageously limited. This static transmission ratio, the value of which is preferably less than −5, can clearly be interpreted as the transmission ratio of the respective internal gear shaft to the respective sun gear shaft when the web or planetary carrier is held fixedly. The static transmission ratio is negative in the case of opposite rotational directions and its amount is always greater than 1.

During the format adjustment which takes place while the machine is running, the necessary adjusting movement is introduced into the drive shaft 112 by the first motor 30. That adjusting movement is superimposed on the movement of the internal gear 109 and is transmitted to the rear edge shaft 24. In this case, the movement of the internal gear 109 is driven by the second motor 31 through the gearwheels 102, 103 and the double gear 108.

It goes without saying that the format, that is to say the spacing 49, can also be adjusted when the machine is at a standstill. In this case, the gearwheel 102 is at a standstill and this standstill is secured by a non-illustrated brake of the machine 1. The front edge shaft 23 is therefore also at a standstill when the adjusting movement is introduced into the gear unit 119 for superimposing two movements by the first motor 30. That adjusting movement is transmitted to the rear edge shaft 24 in a stepped-up manner and in the process changes the relative spacing between the front edge gripping system and the rear edge gripping system.

The setting-up operation can be monitored through the use of a rotary angle measuring system which is disposed on the rear edge shaft 24 or the motor shaft 115 and measures their rotary angle. Only a single angle measuring system is therefore required for monitoring the setting operation. In order to perform this monitoring, it is not necessary to use two different angle measuring systems, in order to measure two different rotary angles with the latter and to calculate the rotary angle difference from the two rotary angles.

In the second exemplary embodiment which is shown in FIG. 3, an internal gear 117 having an internal toothing system 117' which meshes with a planetary gear 110 of the gear unit 119 for superimposing two movements, is seated on the drive shaft 112. The planetary gear 110 is connected to the rear edge shaft 24 through a web or planetary carrier, on which the planetary gear 110 is mounted rotatably. The gearwheel 103, which is seated on the front edge shaft 23, has an eccentric journal, on which a further planetary gear 118 is seated rotatably, with the result that the gearwheel 103 forms the web or planetary carrier of the planetary gear 118. The planetary gear 118 is in engagement with a first toothing system 108' of a double gear 108 which has a second toothing system 108" that is in engagement with the other planetary gear 110. In the exemplary embodiment which is shown in FIG. 3, the second partial gear mechanism 120 is likewise an epicyclic gear mechanism. The toothing system 108" forms the sun gear of the gear unit 119 for superimposing two movements and the toothing system 108' forms the sun gear of the other gear unit for superimposing two movements, that is to say of the partial gear mechanism 120. The double gear 108 is seated rotatably on the rear edge shaft 24. Moreover, the planetary gear 118 is also in engagement with an internal toothing system 101' of the housing 101. The internal toothing system 101' is fixed to the housing and forms an internal gear.

The two partial gear mechanisms 119, 120 of the overall gear mechanism 121 have identical configurations with regard to their transmission ratio, that is to say the tooth number of the planetary gear 110 is exactly as large as the tooth number of the planetary gear 118, the tooth number of the toothing system 108" corresponds to the tooth number of the toothing system 108' and the internal toothing system 117' of the internal gear 117 has the same tooth number as the internal toothing system 101' of the housing 101. As a result of the symmetry of the two partial gear mechanisms 119, 120, there is synchronism between the front edge shaft 23 and the rear edge shaft 24 and therefore a constancy of the spacing 49 (see FIG. 1) if the first motor 30 is at a standstill during printing operation and only the second motor 31 is operating.

If a format adjustment is to be performed between two print jobs and therefore the spacing 49 is to be changed, the adjusting movement which is required for this purpose is introduced into the overall gear mechanism 121 by the first motor 30, with the result that the adjusting movement of the overall gear mechanism 121 is transmitted to the rear edge shaft 24 in a stepped-up manner and therefore the spacing 49 is changed. This format adjustment can take place when the machine is at a standstill, and the second motor 31 and therefore the gearwheel 102 are at a standstill. The standstill can be secured by a non-illustrated brake.

However, the format adjustment can also take place while the machine is running, with both motors 30, 31 operating during the format adjustment in this case. In this case, the adjusting movement which is necessary for the format adjustment is introduced through the drive shaft 112 into the overall gear mechanism 121 by the first motor 30, in which the adjusting movement is superimposed on the drive movement that is introduced by the second motor 31 though the gearwheel 103 and the double gear 108 which acts as sun gear. The differential movement which results from the superimposition is transmitted to the rear edge shaft 24 by the planetary gear 110.

In the exemplary embodiment which is shown in FIG. 3, the format adjustment can be monitored and controlled through the use of the angle measuring system which has already been described in conjunction with the exemplary embodiment shown in FIG. 2. The comments which were made in conjunction with the exemplary embodiment shown in FIG. 2 with respect to the static transmission ratio are also valid analogously for the exemplary embodiment shown in FIG. 3.

In comparison with the exemplary embodiment which is shown in FIG. 3, the exemplary embodiment which is shown in FIG. 2 has the advantage that the torque which reacts on the drive shaft 112 can be kept smaller.

The invention claimed is:

1. A machine for processing printed sheets, the machine comprising:

a sheet delivery having a first conveying device for leading sheet ends, a second conveying device for trailing sheet ends, and a setting device for sheet-format-dependent adjustment of one of said first and second conveying devices relative to the other, said setting device including a gear unit for superimposing two movements, said gear unit for superimposing two movements being an epicyclic gear mechanism;

one of said first and second conveying devices having a hollow shaft, the other of said first and second conveying devices having an inner shaft disposed in said hollow shaft, and said shafts being coupled to one another by said gear unit for superimposing two movements.

2. The machine according to claim 1, which further comprises a drive motor for driving said first and second conveying devices, and an actuating motor for sheet-format-dependent adjustment of one of said first and second conveying devices relative to the other, said drive motor and said actuating motor being connected to said gear unit for superimposing two movements.

3. The machine according to claim 2, which further comprises an overall gear mechanism having first and second partial gear mechanisms, said gear unit for superimposing two movements forming said first partial gear mechanism, a transmission ratio of said first partial gear mechanism and a transmission ratio of said second partial gear mechanism are selected to result in a transmission ratio of 1:1 of said overall gear mechanism when said actuating motor is at a standstill.

4. The machine according to claim 3, wherein said gear unit for superimposing two movements and said second partial gear mechanism are planetary gear mechanisms having sun gears forming a double gear coaxial with said shafts.

5. The machine according to claim 3, wherein said overall gear mechanism includes a housing and a double gear mounted eccentrically relative to said shafts and stationarily in said housing.

6. The machine according to claim 3, wherein said shafts are coupled to one another by said overall gear mechanism, permitting said shafts to be rotated synchronously with one another by said drive motor when said actuating motor is at a standstill.

7. The machine according to claim 3, wherein said shafts are coupled to one another by said overall gear mechanism, permitting one of said shafts to be rotated relative to the other by said actuating motor when said drive motor is running.

8. The machine according to claim 1, wherein:

one of said first and second conveying devices has a first pair of chain sprockets rotationally fixedly seated on said hollow shaft and a first pair of chains wrapped around said first pair of chain sprockets; and the other of said first and second conveying devices has a second pair of chain sprockets rotationally fixedly seated on said inner shaft and a second pair of chains wrapped around said second pair of chain sprockets.

9. The machine according to claim 8, which further comprises holding crossmembers attached to one pair of chains for holding the printed sheets at leading sheet ends, and holding crossmembers attached to the other pair of chains for holding the printed sheets at trailing sheet ends.

10. The machine according to claim 1, wherein said gear unit for superimposing two movements is a planetary gear mechanism.

* * * * *